US005486243A

United States Patent [19]

Hashiguchi et al.

[11] Patent Number: 5,486,243

[45] Date of Patent: Jan. 23, 1996

[54] METHOD OF PRODUCING AN ALUMINUM ALLOY SHEET EXCELLING IN FORMABILITY

[75] Inventors: Koichi Hashiguchi; Yoshihiro Matsumoto; Makoto Imanaka; Takaaki Hira; Rinsei Ikeda; Naoki Nishiyama; Nobuo Totsuka, all of Chiba; Yoichiro Bekki; Motohiro Nabae, both of Tokyo, all of Japan

[73] Assignees: Kawasaki Steel Corporation; The Furukawa Electric Co., Ltd., Japan

[21] Appl. No.: 135,260

[22] Filed: Oct. 12, 1993

[30] Foreign Application Priority Data

Oct. 13, 1992 [JP] Japan ..... 4-274044
Aug. 10, 1993 [JP] Japan ..... 5-198207

[51] Int. Cl.[6] ..... C22F 1/04

[52] U.S. Cl. ..... 148/552; 148/523; 148/527; 148/692

[58] Field of Search ..... 148/264, 265, 148/285, 523, 527, 552, 692

[56] References Cited

U.S. PATENT DOCUMENTS 4,282,044 8/1981 Robertson et al. ..... 148/552
4,812,183 3/1989 Sanders et al. ..... 148/537
5,062,901 11/1991 Tanaka et al. ..... 148/552

FOREIGN PATENT DOCUMENTS 02254143 10/1990 Japan ..... 148/692
05086444 4/1993 Japan ..... 148/692

OTHER PUBLICATIONS

Metals Handbook, "Forming of Nonferrous Metals"; American Society for Metals; 8th Edition, vol. 4 (Forming), pp. 379–380.

*Primary Examiner*—David A. Simmons
*Assistant Examiner*—Robert R. Koehler
*Attorney, Agent, or Firm*—Austin R. Miller

[57] ABSTRACT

A method including preparing an aluminum scrap containing a total of about 0.3 to 2.0 wt % of Fe and Si; melting and then adjusting the material composition so as to attain an Mg content of about 3 to 10 wt % or a composition further containing at least one of the elements Cu, Mn, Cr, Zr and Ti, each in the amount of 0.02 to 0.5 wt %; subjecting the material to casting, hot rolling, cold rolling and continuous annealing to obtain an aluminum alloy sheet having a tensile strength of about 31 kgf/mm$^2$ or more; and applying a lubricant surface coating to impart a coefficient of friction of not more than about 0.11.

11 Claims, 3 Drawing Sheets

METHOD OF PRODUCING AN ALUMINUM ALLOY SHEET EXCELLING IN FORMABILITY

BACKGROUND OF THE INVENTION

1. Field of the Invention

The present invention relates to an aluminum alloy sheet suitable for use as an automobile body sheet and for making formed parts of household electric apparatuses, and a method of producing the same. More specifically, the present invention provides an aluminum alloy sheet having excellent strength, formability and weldability at low cost.

2. Description of the Related Art

As a result of the recent demand for a reduction in weight of automobile bodies, extensive use of aluminum alloy sheets for body sheets is being considered. Accordingly, aluminum alloy sheets are required to be excellent in press formability, weldability and strength as conventional cold-rolled steel sheets. To meet such requirements, 5000-Series alloys of the Al—Mg type and, more specifically, Alloys No. 5052, 5182, etc. are being employed. A problem with these alloys, however, is that their r-values, which serve as an index of ductility and deep drawability, are much lower than those of steel sheets. Thus, it is difficult for these alloys to be worked in a manner equivalent to steel sheets, so that their application is restricted to parts not requiring much working, such as hoods.

Further, aluminum alloy sheets are poorer in resistance-spot-welding properties as compared with steel sheets. In particular, they have a problem in that electrode life during continuous spot welding tends to be extremely short, so that dressing prior to electrode life expiration or electrode replacement has to be frequently performed, resulting in poor production efficiency.

Various efforts have been made to attain an improvement in the formability of aluminum alloy sheets. For example, as disclosed in Japanese Patent Laid-Open No. 61-130452, a method has been developed according to which an improvement in elongation is attained by setting an upper limit to the amounts of Fe and Si and, at the same time, adding a large amount of Mg. With these techniques, it has been essential, from the viewpoint of formability, to use a new raw metal (a new aluminum ingot, a prime metal) having a high purity of 99.7% or more, in both conventional 5000-Series metals and newly developed high-ductility alloys, as the raw metal thereof, due to the restriction in purity to ensure the requisite elongation.

However, as is well known, new aluminum raw metal is expensive, so that aluminum alloy sheets are much more expensive than steel sheets.

Nevertheless, the elongation percentage of aluminum sheets obtained by the above-described conventional techniques is not more than 40%, which is markedly lower as compared with 40% or more of steel sheets.

As disclosed in Japanese Patent Laid-Open No. 4-123879, a method has been developed of providing an electrically insulating coating on the surface of an aluminum alloy sheet in order to achieve an improvement in weldability (evaluated by the length of electrode life), which method, however, does not help to improve formability and weldability.

SUMMARY OF THE INVENTION

It is accordingly an object of the present invention to provide an aluminum alloy sheet which has a high level of strength and excels in formability. Another object of the present invention is to provide an aluminum alloy sheet which helps to achieve satisfactory weldability, that is, long electrode life. Still another object of the present invention is to provide an alloy sheet having such characteristics at low cost.

In accordance with the present invention, there is provided an aluminum alloy sheet excelling in formability which consists of about 3 to 10 wt % of Mg and a total of about 0.3 to 2.0 wt % of the elements Fe and Si, which surprisingly coact with the Mg, and the balance essentially Al, the aluminum alloy sheet being provided with a lubricant surface coating and having a coefficient of friction of not more than about 0.11. Further, the aluminum alloy sheet may contain strengthening elements, such as Cu, Mn, Cr, Zr and Ti, as needed.

Further, in accordance with the present invention, a method of producing aluminum alloy sheets is provided comprising the steps of: preparing aluminum scrap consisting of a total of about 0.3 to 2.0 wt % of Fe and Si as impurity elements and the balance essentially Al; melting the prepared aluminum scrap and adjusting its composition to attain an Mg content of about 3 to 10 wt % with or without further elements Cu, Mn, Cr, Zr and Ti, each in the amount of about 0.02 to 0.5 wt %; subjecting the resulting material to casting, hot rolling, cold rolling and continuous annealing to obtain an aluminum alloy sheet having a tensile strength of about 31 kgf/mm$^2$ or more; and providing this aluminum alloy sheet with a lubricant surface coating so as to impart thereto a coefficient of friction of not more than about 0.11. The coefficient of friction referred to above is defined by using a flat-type tool (Japanese Industrial Standards SKD11, finished state being ▽▽▽) with its length of contacting surface at 10 mm with a test plate specimen of 20 nun wide. By having the flat-type tool press the test plate specimen on obverse and reverse sides with a pressing force P and the drawing power F is measured and the coefficient of friction is calculated by a formula:

$$\mu = F/2P.$$

DESCRIPTION OF THE PREFERRED EMBODIMENTS

The composition of the alloy sheet of the present invention, the lubricant coating provided thereon, and the method of producing this alloy sheet will now be specifically described.

(1) Alloy Composition

Mg: The aluminum alloy to be used in the present invention is an Al—Mg-type alloy containing about 3 to 10 wt % of Mg. The strength of the material is mainly obtained from the solid-solution strengthening mechanism of the Mg atoms, the strength and elongation of the material increasing in proportion to the Mg content. However, with an Mg content of less than about 3 wt % the requisite strength for a structural material such as an automobile body panel cannot be obtained, nor can the desired level of elongation be attained. The requisite formability;is not obtainable even when combined with lubrication processing as described below. Thus, from the viewpoint of strength and formability a larger Mg amount is more advantageous. However, adding Mg in an amount exceeding about 10 wt % results in a deterioration in hot workability, thereby making sheet production difficult. For the above reasons, the range of the Mg amount is determined as about 3 to 10 wt %.

Factors causing deterioration in the elongation of an Al—Mg-type alloy are inter-metallic compounds of the Fe—Al and Mg—Si-types. Accordingly, it has generally been deemed desirable for the amounts of elements such as Fe and Si to be kept as small as possible. Accordingly, a high-purity raw metal (a new aluminum ingot, a prime metal) is usually adopted, which results in increased production cost because of the high price of the raw metal. To attain cost reduction, the present invention uses recycled scrap as the metal.

Figure 1:
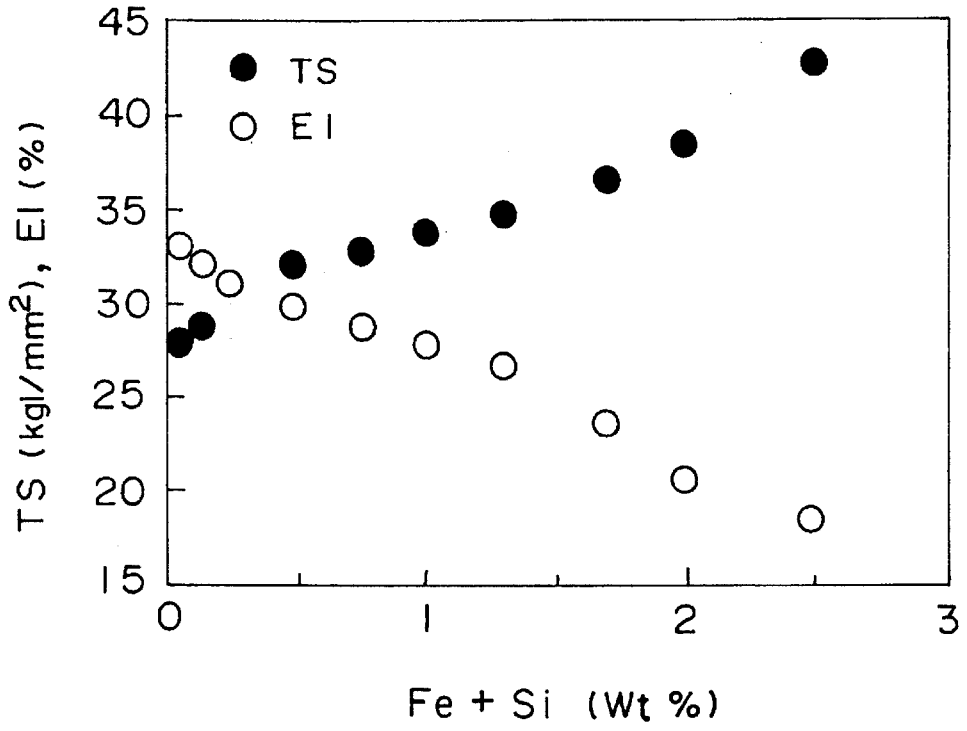
FIG. 1 is a graph showing the influence of the amount of impurities Fe+Si on the tensile strength and elongation of an aluminum alloy sheet.
Figure 2:
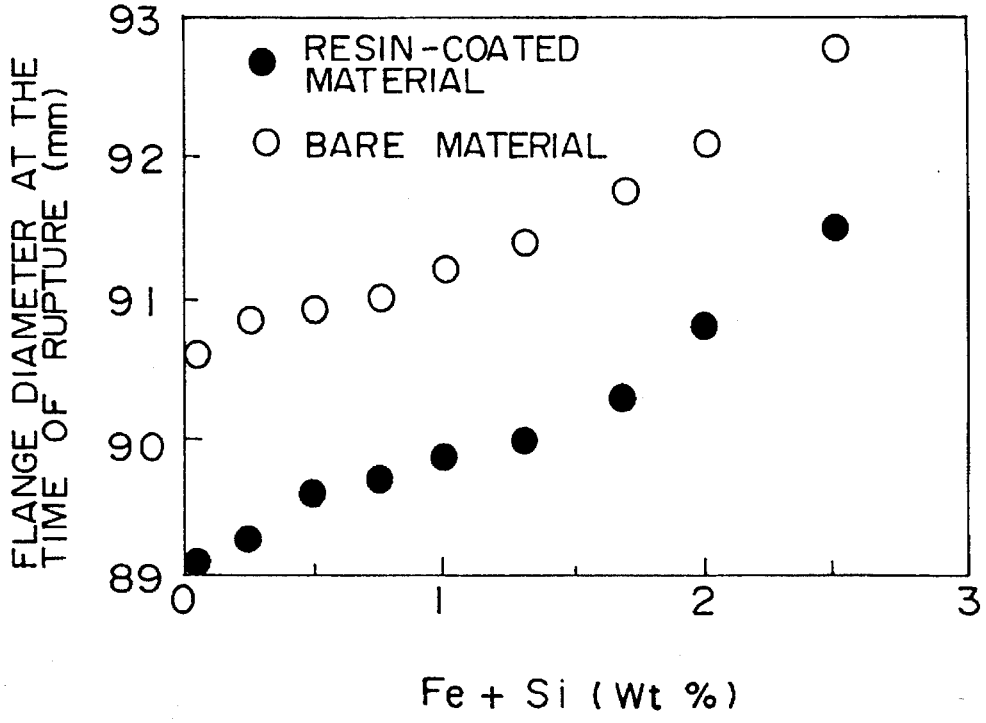
FIG. 2 is a graph showing the influence of the amount of impurities and a lubricant resin coating on the cup formability of an aluminum alloy sheet.

When the amounts of elements Fe and Si are increased while keeping the Mg amount constant, the elongation of the material, which is a representative index of formability, radically deteriorates, as shown in FIG. 1, with the result that the flange diameter during cup formation, which is used as a formability index, also increases, as shown in FIG. 2, resulting in substantial deterioration in formability. Therefore, it has generally been deemed impossible to obtain a material allowing complicated formation as in the case of a car body from such a low-purity material as scrap.

However, as shown in FIG. 2, it has been surprisingly discovered that, with an Mg content of about 3 to 10 wt % and with an Fe—Si amount of not more than about 2 wt %, it is possible to create a material having a formability equivalent to that of new raw metal, if the material is subjected to lubrication processing. In view of this, the upper limit of the total amount of beneficial Fe and Si is determined as about 2 wt %. This makes it possible to attain a significant reduction in cost. To obtain better formability, however, it is desirable for the Fe—Si amount to be kept as small as possible. However, taking the cost of the aluminum scrap into consideration, and the desired overall properties of the material, the lower limit of the Fe—Si amount was determined as about 0.3 wt %. Further, to attain formability equivalent to that of a material based on a high-purity raw metal, by lubrication processing, it is desirable for the elongation of the material to be not less than about 20 wt %. This can be achieved with the amount of Si and Fe kept to about 2 wt % or less.

Figure 3:
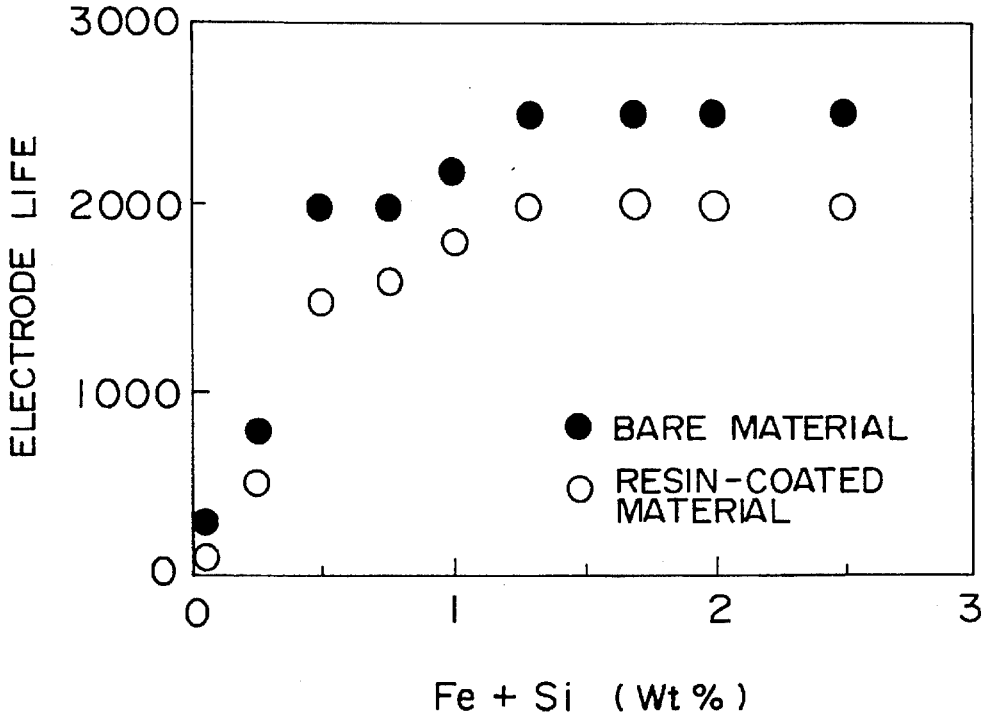
FIG. 3 is a graph showing the influence of the amounts of impurities Fe+Si on electrode life when performing spot welding on an aluminum alloy sheet.

On the other hand, an increase in the Fe—Si amount surprisingly provides a positive effect in combination with the presence of about 3 to 10 wt % of Mg. As shown in FIG. 3, with the increase in the Fe—Si amount, the resistance spot welding property of the aluminum alloy sheet is remarkably improved. It is speculated that this phenomenon, the reason for which has not been clarified yet, is attributable at least in part to the increase in strength caused by the increase in Fe—Si amount and the effect of the Fe and Si themselves. That is, as shown in FIG. 1, it is suspected that the increase in strength, caused by an increase in the amount of impurities, results in an increase in the breakdown amount of the surface oxide film directly below the electrode when the aluminum alloy sheet is pressurized, with the result that the heat generation between the sheet and the electrode is restrained to lessen the wear of the electrodes, and that the expansion of the sheet area, where electricity is charged during welding, is restrained, thereby ensuring a sufficient current density between the sheets. Due to the interaction of these two effects, an improvement in electrode life is attained. Further, the increase in the Fe—Si amount causes an increase in the specific resistance of the aluminum alloy sheet and a reduction in the heat conductivity thereof, so that the dissolution of the sheet section being welded is promoted, thereby improving the weldability of the sheet. To achieve such an improvement, it is desirable for the lower limit of the impurity amount and the lower limit of the tensile strength to be about 0.3% and 31 kgf/mm$^2$, respectively. The weldability is evaluated on the basis of number of continuous welding spots of the resistance spot welding.

Other Elements Selectively Added

Addition of elements such as Cu, Mn, Cr, Zr and Ti is desirable since it causes an increase in strength, resulting in an improvement in formability and electrode life during welding. To achieve such an effect, the lower limit of these elements to be added is determined as about 0.02 wt %. However, since adding an excessive amount of these elements results in deterioration in elongation and corrosion resistance, the upper limit is determined as about 0.5 wt %. The effect of these elements is obtained with the addition of only one of them, or a plurality, or all of them.

(2) Lubrication Coating

Lubrication Coating

Figure 4:
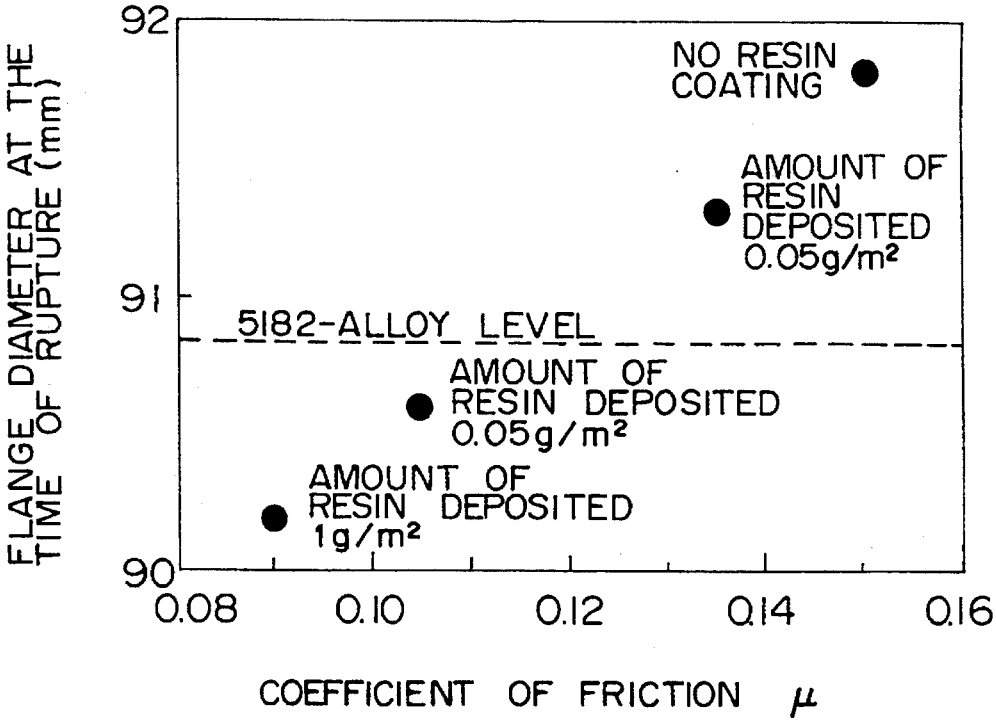
FIG. 4 is a graph showing the influence of coefficient of friction on the cup formability of an aluminum alloy sheet.

The lubrication coating is another important factor. As shown in FIG. 2, a material which cannot withstand press working in a bare state can be substantially improved in formability by adding a lubrication property. As an example, the lubrication property can be realized by resin coating. The resin may be a removable-type resin, such as wax, or a non-removable-type organic resin, such as epoxy-type resins containing wax. However, taking the car body production process into consideration, the non-removable-type resins, which allow welding and painting as they are, are more preferable than the non-removable-types, which require degreasing after press working. The kind and thickness of this resin must be selected in such a way that the coefficient of friction $\mu$ as defined before is about 0.11 or less, as shown in FIG. 4. That is, an upper limit of about 0.11 was set to the coefficient of friction $\mu$ for improving the material, containing Fe and Si in an amount of approximately 1.5 wt %, to such a degree as to provide a formability equivalent to that (with no lubrication coating) based on a conventional new raw metal. On the other hand, from the viewpoint of the resistance continuous spot welding property, the lubricant coating tends to lead to deterioration in weldability since it promotes the wear of the electrode tip by welding. However, as stated above, the weldability when in a bare state of a material which contains a large amount of Mg or Fe—Si is greatly improved, so that no deterioration in weldability as compared to the conventional materials will occur even when a lubricant coating is provided. Therefore, the kind and thickness of the resin coating were determined in accordance with the limit value for improving the formability of the material. Preferable examples of the lubricant coating include epoxy-type or epoxy-urethane-type organic resins based on a chromate coating and containing wax.

(3) Manufacturing Process

To manufacture the alloy sheet of the present invention, it is expedient to use aluminum scrap, which helps to produce the alloy sheet of the present invention at low cost. The total amount of Fe and Si as impurities is restricted to the range of about 0.3 to 2.0 wt % so as to ensure the requisite characteristics.

Figure 5:
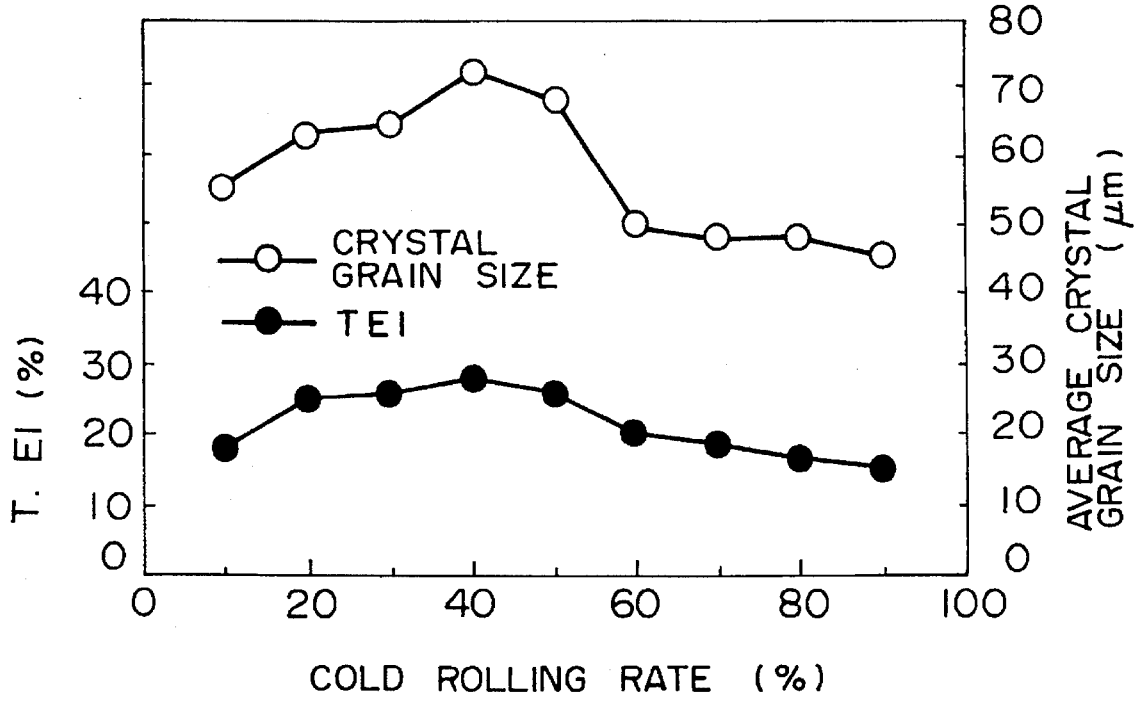
FIG. 5 is a graph showing the relationship between the cold rolling reduction rate and elongation of an aluminum alloy sheet.

After the melting of the scrap, Mg is added. Its content is adjusted to about 3 to 10 wt %. Thus, a molten metal consisting essentially of about 3 to 10 wt % of Mg, total of about 0.3 to 2.0 wt % of Fe+Si, and the balance Al except for incidental impurities, is obtained. After that, casting and hot rolling are conducted in the normal fashion. Then, cold rolling is performed preferably with a cold rolling reduction rate of about 20 to 50%. A large amount of impurities inevitably leads to a poor grain growth characteristic at the time of annealing conducted after the cold rolling. However, as shown in FIG. 5, grain growth occurs to a remarkable degree within the rolling reduction rate of about 20 to 50%, with the elongation also being satisfactory. By utilizing this phenomenon, an improvement in formability is achieved.

After cold rolling continuous annealing is performed in the normal manner, and a requisite lubricant coating is performed on the material, thereby completing the product.

EXAMPLES

The present invention will now be described with reference to specific examples.

(Example 1)

Various aluminum alloys were prepared by varying the amounts of Fe+Si % within the range of about 0.05 to 2.5 wt % while keeping the Mg amount at approximately 5.5 wt %, and the balance essentially Al . The thus obtained materials were subjected to an ordinary hot rolling, and then to cold rolling with a rolling reduction ratio of 30 to 40% to obtain cold rolled sheet having a thickness of 1 mm, and then annealing at 500° to 550° C. was performed for a short period of time, effecting resin coating on some of them. These materials were examined for tensile characteristic and cup formability. FIG. 1 shows the relationship between the tensile strength, elongation and Fe—Si amounts of a material on which no resin coating has been provided after the annealing. FIG. 2 shows the relationship between cup formability and impurity amount. The resin-coated material shown was prepared by applying 0.3 to 0.5 g/m$^2$ of an urethane-epoxy-type resin (urethane: Olester manufactured by Mitsui Toatsu Chemicals, Inc.; epoxy: Epicoat 1007 manufactured by Yuka Shell Epoxy Co., the two being mixed together in a proportion of 1:1) containing 10 wt % of wax (SL 630 manufactured by Sunnopko Co.). Cup-formability evaluation was conducted by applying a low-viscosity oil to a blank plate of 95 mm in diameter and working the material with a flat-head punch of 50 mm in diameter, measuring the flange diameter at the time of rupture. The resin coating remarkably improves the formability of the material even when it contained substantial amounts of Fe and Si and its elongation percentage was low. Further, FIG. 3 shows the influence of the Fe—Si amount on the life of resistance spot welding electrodes. It is apparent from the drawing that the electrode life was remarkably improved as the amount of Fe and Si increased.

(Example 2)

Next, aluminum alloy materials consisting of 1.5 wt % of Fe+Si, with 5.5 wt % of Mg added thereto, and the balance Al, except for incidental impurities, were prepared using the same resin as in Example 1, with the resin coating amount varied 0.05, 0.4, and 1 g/m$^2$. These materials were examined for coefficient of friction and cup formability. The relationship obtained is shown in FIG. 4, which also shows the formability level of a usual 5182 alloy (Fe—Si amount<0.3 wt %, Mg content: 4.5 wt %). As the resin thickness was increased, the coefficient of friction μ decreased, with the result that formability was improved. A formability equivalent to that of the conventional 5182 alloy was obtained when μ was approximately 0.11.

(Example 3)

Further, aluminum alloy sheets having the alloy compositions as shown in Table 1 were prepared by using aluminum scrap containing Fe and Si, and was examined for formability and weldability. The results are given in Table 1.

As is apparent from these results, those alloy sheets whose alloy component deviated from the range of the present invention were rather poor in formability and weldability.

The aluminum alloy sheets manufactured by the method of this invention used inexpensive scrap as a starting material. They could be produced at a far lower cost than conventional aluminum alloy sheets and yet provided a formability and weldability equivalent to or even better than those of the conventional aluminum alloy sheets, thereby providing an optimum material for mass production of car bodies or formed parts of household electric apparatus.

TABLE 1

| COMPOSITION OF ALLOY (wt %) | | | | | | MECHANICAL PROPERTIES | | FLANGE DIAMETER AT THE TIME OF RUPTURE (mm) | | CONTINUOUS SPOT NUMBER | | |
|---|---|---|---|---|---|---|---|---|---|---|---|---|
| Mg | Fe | Si | Fe + Si | OTHER ELEMENTS | Al AND INCIDENTAL IMPURITIES | TS (kgf/mm$^2$) | El (%) | BARE | RESIN-COATED | BARE | RESIN-COATED | EXAMPLE NO. |
| 5.5 | 0.03 | 0.02 | 0.05 | — | Balance | 28 | 33 | 90.6 | 89.1 | 300 | 100 | COMP. EX. 1 |
| 5.5 | 0.3 | 0.2 | 0.5 | — | Balance | 32 | 30 | 90.9 | 89.6 | 2000 | 1500 | EXAMPLE 1 |
| 6.5 | 0.3 | 0.3 | 0.6 | — | Balance | 33 | 30 | 90.8 | 89.4 | 2200 | 1700 | EXAMPLE |

TABLE 1-continued

| COMPOSITION OF ALLOY (wt %) | | | | | | MECHANICAL PROPERTIES | | FLANGE DIAMETER AT THE TIME OF RUPTURE (mm) | | CONTINUOUS SPOT NUMBER | | |
|---|---|---|---|---|---|---|---|---|---|---|---|---|
| Mg | Fe | Si | Fe + Si | OTHER ELEMENTS | Al AND INCIDENTAL IMPURITIES | TS (kgf/mm$^2$) | El (%) | BARE | RESIN-COATED | BARE | RESIN-COATED | EXAMPLE NO. |
| | | | | | | | | | | | | 2 |
| 5.5 | 0.3 | 0.2 | 0.5 | Cu/0.3 | Balance | 35 | 30 | 90.7 | 89.5 | 1900 | 1600 | EXAMPLE 3 |
| 5.5 | 0.4 | 0.2 | 0.6 | Mn/0.4 | Balance | 37 | 29 | 90.6 | 89.2 | 2100 | 1700 | EXAMPLE 4 |
| 5.8 | 0.3 | 0.3 | 0.6 | Cr/0.3 | Balance | 36 | 29 | 90.8 | 89.4 | 2000 | 1600 | EXAMPLE 5 |
| 6 | 0.5 | 0.3 | 0.8 | Zr/0.2 | Balance | 36 | 28 | 90.9 | 89.5 | 2200 | 1700 | EXAMPLE 6 |
| 5.9 | 0.4 | 0.4 | 0.8 | Tr/0.2 | Balance | 37 | 29 | 90.6 | 89.3 | 2100 | 1700 | EXAMPLE 7 |
| 6 | 0.5 | 0.5 | 1 | — | Balance | 34 | 28 | 91 | 89.7 | 2200 | 1700 | EXAMPLE 8 |
| 5.7 | 1 | 0.7 | 1.7 | — | Balance | 37 | 21 | 91.7 | 90.2 | 2500 | 2000 | EXAMPLE 9 |
| 5.4 | 1.5 | 1 | 2.5 | — | Balance | 43 | 19 | 92.8 | 91.4 | 3000 | 2200 | COMP. EX. 2 |

What is claimed is:

1. A method of producing aluminum alloy sheets having satisfactory formability, said method comprising the steps of: preparing aluminum scrap consisting essentially of a total of about 0.3 to 2.0 wt % of Fe and Si, and the balance Al except for incidental impurities; melting the prepared scrap and then adjusting its composition to attain an Mg content of about 3 to 10 wt %; subjecting the resulting material to hot rolling, cold rolling at a total reduction of about 20 to 50% and continuous annealing; and applying a lubricant surface coating so as to impart to the resulting material a sliding resistance of not more than about 0.11.

2. The method as claimed in claim 1, in wherein after melting said prepared scrap, adjusting its composition to provide contents of Cu, Mn, Cr, Zr and Ti of about 0.02 to 0.5 wt %.

3. The method defined in claim 1 wherein said lubricant surface coating is wax.

4. The method defined in claim 1 wherein said lubricant surface coating is an epoxy resin containing wax.

5. The method defined in claim 1 wherein said lubricant surface coating is an epoxy-urethane resin containing wax.

6. A method of producing an aluminum alloy sheet superior in strength, formability and weldability comprising the steps of:

preparing aluminum scrap consisting essentially of a total of about 0.3 to 2.0 wt % of Fe and Si, and the balance Al except for incidental impurities;

melting said aluminum scrap and adjusting Mg content to range from 3 to 10 wt % to form an Al alloy ingot;

hot-rolling said alloy ingot to obtain a hot-rolled sheet;

cold-rolling the hot rolled sheet to obtain an aluminum alloy sheet of a final thickness and annealing the cold rolled sheet;

applying a chromate coating as a base coating on the cold-rolled sheet; and applying a lubricating coating of epoxy-type or epoxy-urethane type organic resins containing wax on said base coating to attain a coefficient of friction not greater than0.11.

7. A method according to claim 6 wherein, after melting of said aluminum scrap, the content of each of Cu, Mn, Cr, Zr and Ti is adjusted to range from 0.002 to 0.5 wt %.

8. A method of producing an aluminum alloy sheet superior in strength, formability and weldability comprising the steps of:

preparing aluminum scrap consisting essentially of a total of about 0.3 to 2.0 wt % of Fe and Si, and the balance Al except for incidental impurities;

melting said aluminum scrap and adjusting Mg content to range from about 3 to 10 wt % to form an Al alloy ingot;

hot-rolling said alloy ingot to obtain a hot-rolled sheet;

cold-rolling the hot rolled sheet at a total reduction of 20 to 50% to obtain an aluminum alloy sheet of a final thickness and annealing the cold rolled sheet; and applying a non-removable organic lubricating coating on said cold rolled sheet to attain a coefficient of friction not greater than about 0.11.

9. The method according to claim 8 wherein said non-removable organic lubricating coating is an epoxy or epoxy-urethane organic resin containing wax.

10. A method of producing an aluminum alloy sheet superior in strength, formability and weldability consisting essentially of:

preparing aluminum scrap consisting essentially of a total of about 0.3 to 2.0 wt % of Fe and Si, and the balance Al except for incidental impurities;

melting said aluminum scrap and adjusting Mg content to range from about 3 to 10 wt % to form an Al alloy ingot;

hot-rolling said alloy ingot to obtain a hot-rolled sheet;

cold-rolling the hot rolled sheet to obtain an aluminum alloy sheet of a final thickness and annealing the cold rolled sheet;

applying a chromate coating as a base coating on the cold-rolled sheet; and applying a non-removable organic lubricating coating on said base coating to attain a coefficient of friction not greater than about 0.11.

11. A method of producing an aluminum alloy sheet superior in strength, formability and weldability comprising the steps of:

preparing aluminum scrap consisting essentially of a total of about 0.3 to 2.0 wt % of Fe and Si, and the balance Al except for incidental impurities;

melting said aluminum scrap and adjusting Mg content to range from about 3 to 10 wt % to form an Al alloy ingot;

hot-rolling said alloy ingot to obtain a hot-rolled sheet;

cold-rolling the hot rolled sheet at a total reduction of 30 to 40% to obtain an aluminum alloy sheet of a final thickness and annealing the cold rolled sheet; and applying a non-removable organic lubricating coating on said cold rolled sheet to attain a coefficient of friction not greater than about 0.11.

* * * * *

UNITED STATES PATENT AND TRADEMARK OFFICE

CERTIFICATE OF CORRECTION

PATENT NO. : 5,486,243

DATED : January 23, 1996

INVENTOR(S) : Koichi Hashiguchi, Yoshihiro Matsumoto, Makoto Imanaka, Takaaki Hira, Rinsei Ikeda, Naoki Nishiyama, Nobuo Totsuka, Yoichiro Bekki and Motohiro Nabae It is certified that error appears in the above-indentified patent and that said Letters Patent is hereby corrected as shown below:

In Columns 7 and 8, in TABLE 1-continued, under the subheading "El (%)", the seventh row down, please change "21" to --24--.

In Column 7, line 58, after "sheet", please insert --at a total reduction of about 20 to 50%--;
line 64, please delete "-type"; and
line 65, please delete "type".

In Column 8, line 59, after "sheet", please insert --at a total reduction of about 20 to 50%--.

Signed and Sealed this

Eighteenth Day of June, 1996

*Attest:*

Bruce Lehman

BRUCE LEHMAN

*Attesting Officer*

*Commissioner of Patents and Trademarks*